United States Patent [19]

Focke

[11] 4,385,479

[45] May 31, 1983

[54] APPARATUS FOR THE PREPARATION OF PACKAGING BLANKS BY SEVERING FROM A CONTINUOUS WEB

[75] Inventor: Heinz H. Focke, Verden, Fed. Rep. of Germany

[73] Assignee: Focke & Co., Verden, Fed. Rep. of Germany

[21] Appl. No.: 212,308

[22] Filed: Dec. 3, 1980

[30] Foreign Application Priority Data

Dec. 11, 1979 [DE] Fed. Rep. of Germany ..... 2949685

[51] Int. Cl.[3] ..... B65B 41/16

[52] U.S. Cl. ..... 53/389; 53/228; 493/363; 83/325; 83/300

[58] Field of Search ..... 53/234, 389, 228, 230, 53/232; 83/422, 349, 325, 300, 301, 302, 303; 198/817, 689

[56] References Cited

U.S. PATENT DOCUMENTS

| | | | |
|---|---|---|---|
| 3,075,325 | 1/1963 | Liedtke | 53/32 |
| 3,277,630 | 10/1966 | Youngman et al. | 53/389 |
| 3,385,026 | 5/1968 | Schmermund | 53/228 |
| 3,917,092 | 11/1975 | McGinnis | 214/83.36 |
| 4,151,699 | 5/1979 | Fock et al. | 53/228 |

*Primary Examiner*—Nicholas P. Godici
*Assistant Examiner*—Kurt Rowan
*Attorney, Agent, or Firm*—Sughrue, Mion, Zinn, Macpeak and Seas

[57] ABSTRACT

A pair of parallel conveyor belts 20, 21 are spaced apart less than the width of a web 11 of packaging material to be transported, but greater than the width of a package to be wrapped in blanks 10 severed from the web. Suction holes 24 in the inner edges of the belts hold the overlapping outer edges of the web. A transverse knife 27 slightly wider than the web passes through oblong cutouts 30, 31 in the inner edges of the belts to sever the blanks, which are subsequently U-wrapped around packages 13 individually pushed between the belts.

4 Claims, 6 Drawing Figures

Figure 1:
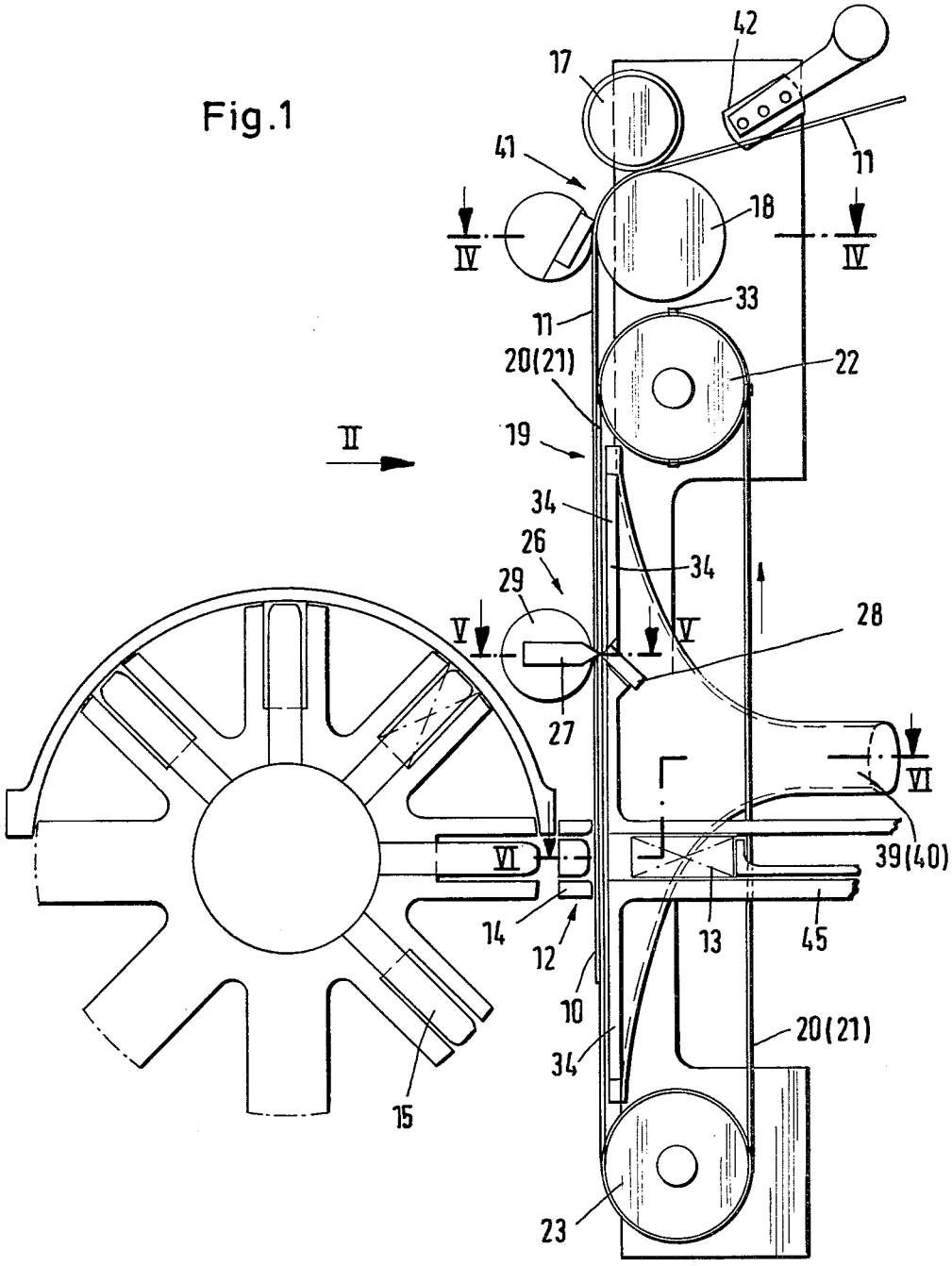

APPARATUS FOR THE PREPARATION OF PACKAGING BLANKS BY SEVERING FROM A CONTINUOUS WEB

DESCRIPTION

The invention relates to an apparatus for the preparation of packaging blanks by severing from a continuous web and for feeding a blank to a pack or the like, the packaging blank being severable from the continuous web by means of severing blades, and the web including the blank being transportable by means of belts which grip these at least in the zone of their lateral edges.

The preparation of blanks and their trouble-free transport within a packing machine or the like is a particularly difficult problem, above all if the blanks consist of a thin-walled material or a material which is critical for other reasons. The problem is thus particularly acute in the processing of thin-walled plastic films, regenerated cellulose film and the like. In order to be able to feed the blanks, severed from a continuous web of the packaging material, without trouble, in particular with an exact relative position and free from folds, to a pack or another processing station, it is desirable that the web and thereafter the blanks are uninterruptedly held and guided during the transport. This aim of continuously guided, fixed conveying of the web and blank is countered by the necessity of severing the blanks from the web by means of transversely directed severing cuts. For this purpose, severing blades are conventionally used, which revolve or are moved in some other way, but which are in any case arranged and act transversely to the web.

In a known apparatus for solving this problem, as described in U.S. Pat. No. 4,151,699, the transversely directed severing cuts for dividing off the blanks are applied in two mutually complementary part cuts. Initially, the web running in is provided with two part cuts, each in the lateral zone. Subsequently thereto, the web enters the zone of lateral belts which are subjected to suction air. These belts grip the web in the zone of the previously made part cuts. In the zone of the conveying path of the belts, a further part cut is then made between the latter, which further cut, complementing the part cuts made initially, effects severing of the blank. The web and the blank are thus guided and held over the entire conveying path.

It is the object of the invention to propose an apparatus, as a result of which reliable conveying and guiding of a web of packaging material and of the blanks severed from the latter is possible with simpler means.

To achieve this object, the invention comprises belts which are provided with recesses which are arranged transversely to the conveying direction and are intended to let the severing blade pass through.

Preferably, the web and the blank are conveyed and guided by two lateral belts which grip the web, and afterwards the blank, in the zone of their lateral edges. According to the invention, inward-opening elongate holes are here provided in the belts, that it to say on the mutually facing sides, the end zones of the severing blade entering the elongate holes when a severing cut is carried out.

In the invention, the complete severing cut is accordingly made in one working step by means of a severing blade which is appropriately designed, arranged and sized. The web and afterwards the packaging blank are guided, before and after the zone of the severing cut, by lateral belts which are subjected to suction air. A part zone of the severing blade which necessarily has a transverse dimension greater than the distance between the inner edges of the belts, thus enters the recesses in the belts.

The belts are arranged at such a distance from one another that a pack can be passed through between them transversely to the plane of the belts, and in particular while taking along the blank held by the belts. For this purpose, the belts are taken beyond the zone of a pick-up or packaging station, so that the blank is drawn off the belts with slip. This arrangement of the belts also enables the apparatus to operate continuously.

The severing blade which is preferably fitted on a revolving blade roller and interacts with a stationary counter-blade, runs synchronously with the belts, preferably at the same speed. According to the invention, the lengths of the severed packaging blanks can here be determined by draw rollers which are located in front of the belts in the conveying direction and which, in the extreme case, namely for maximum length of the packaging blanks, revolve at the same speed as the belts. In the case of shorter packaging blanks, the web is conveyed with slip in the zone of the belts up to the severing point, as a result of an appropriately adjusted speed of the draw rollers.

Further features of the invention are the subject of sub-claims.

Figure 2:
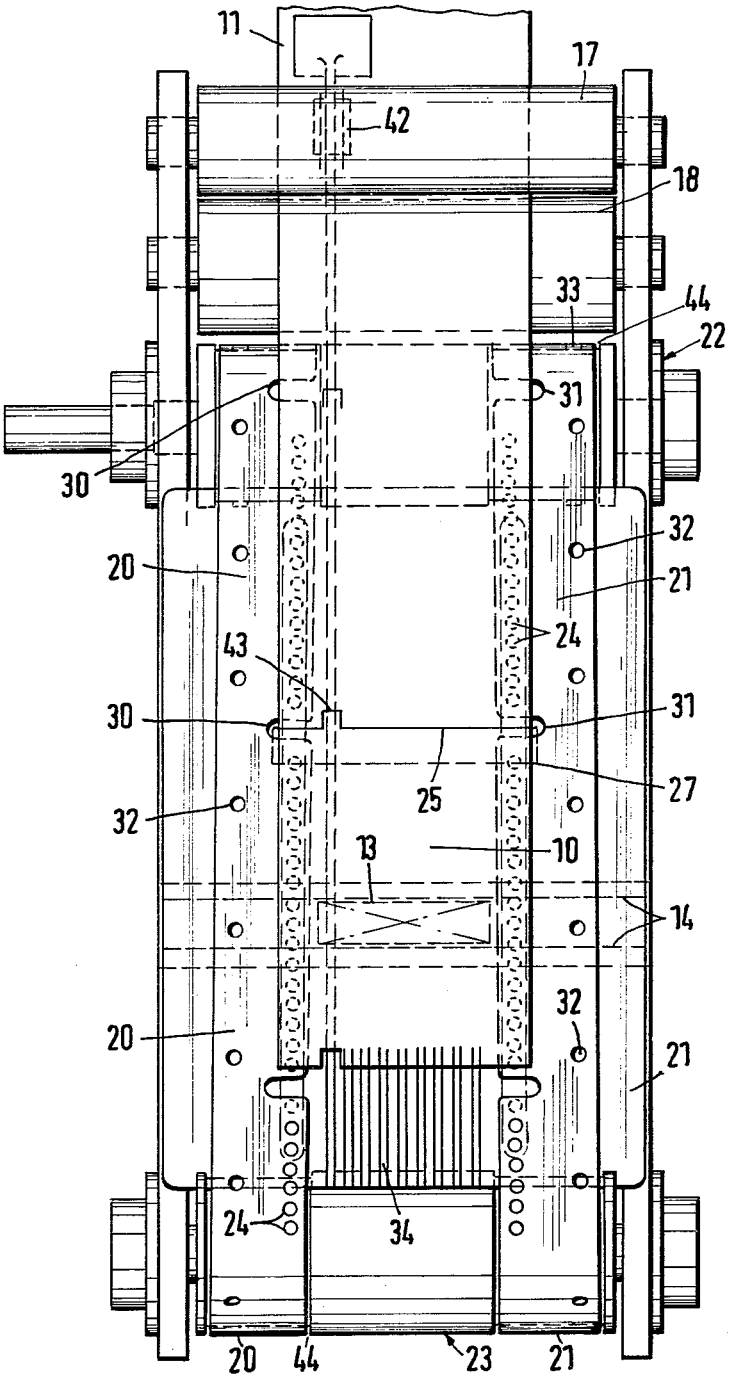
Figure 3:
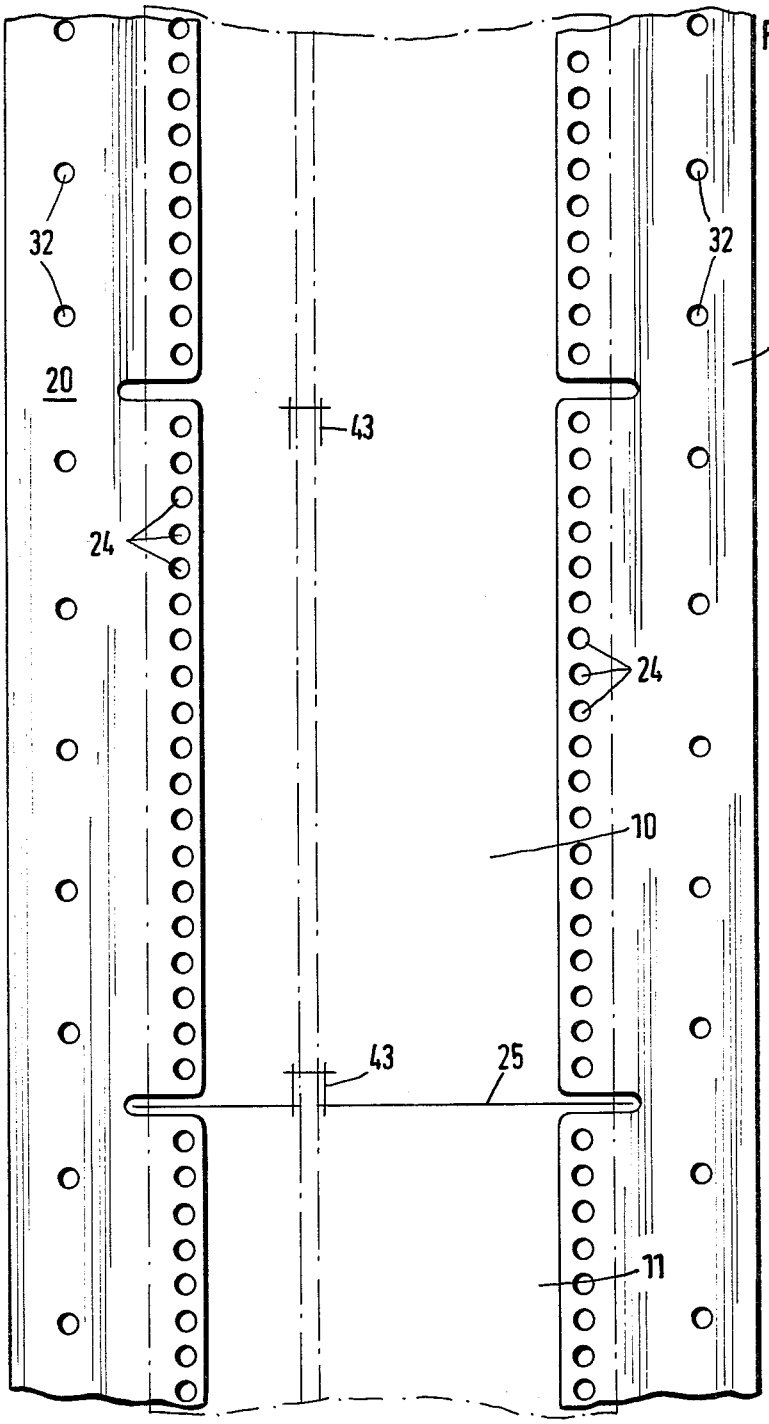
Figure 4:
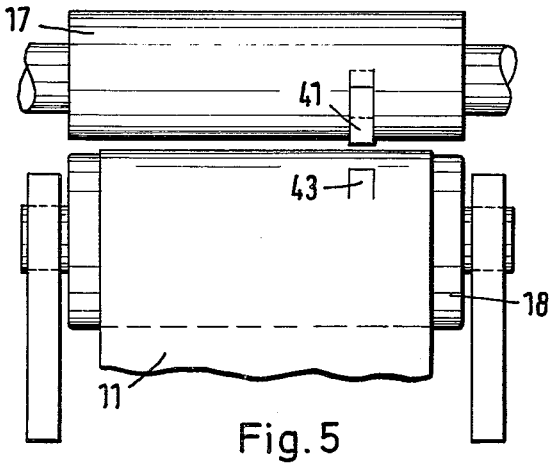
Figure 5:
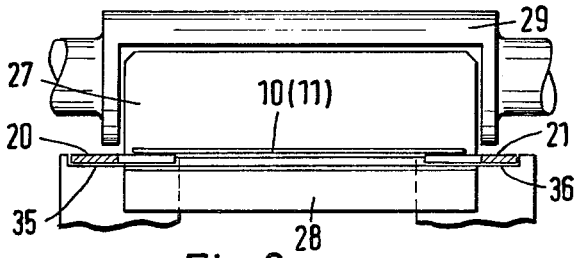
Figure 6:
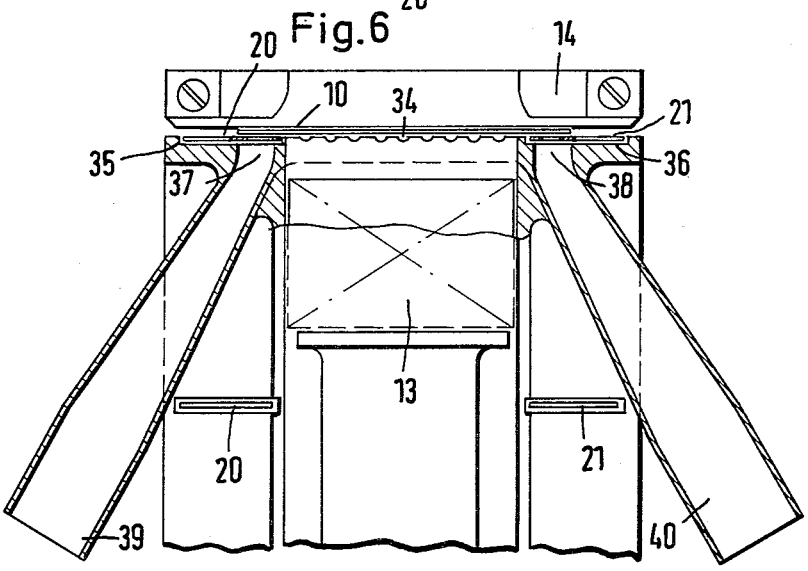

An illustrative embodiment of the invention is explained in more detail in the following text by reference to the drawings in which:

FIG. 1 shows an apparatus for the preparation and guiding of packaging blanks, in a diagrammatic side view, FIG. 2 shows a front view of a part of the apparatus, corresponding to the arrow II in FIG. 1, FIG. 3 shows a part of the conveying path of the apparatus in side view, on an enlarged scale, FIG. 4 shows a horizontal section IV—IV of FIG. 1 in the zone of a first blade arrangement, FIG. 5 shows a further horizontal section V—V of FIG. 1 in the zone of the blade arrangement carrying out the severing cut, and FIG. 6 shows an offset cross-section VI—VI in FIG. 1.

In the illustrative embodiment of the apparatus shown, packaging blanks 10 are severed from a continuous web 11 of the packaging material, for example a plastic film, and are fed in a vertical plane to a processing station 12. In the zone of the latter, the blank is folded U-shaped around a pack 13, fed in transversely, or another article. The pack 13 is here transported on a horizontal packing line 45 and is passed through a mouthpiece 14, while taking along the packaging blank 10 held ready in a vertical plane. The packaging blank 10 is thus laid in a U-shape around the pack 13. After the mouthpiece 14, the pack 13 and packaging blank 10 are received in a pocket 15 of a folding turret 16.

The web 11 running in from above is conveyed by two driven draw rollers 17 and 18, the speed of which is controllable. After these draw rollers 17 and 18, the web 11 enters the zone of a guided conveying path. The latter is defined by vertically arranged, revolving belts 20 and 21. By means of the latter, initially the web 11 and, in the further course of the vertical conveying path, the packaging blank 10 are gripped, conveyed and held.

The stretch-resistant, flexible belts 20, 21 run over common upper and lower guide rollers 22 and 23, of which the upper, for example, can be driven. To guide the belts 20, 21, the guide rollers 22, 23 are provided with depressions 44 of approximately the width of the belts 20, 21.

The belts 20 and 21 are arranged at such a distance from one another that lateral strips of the web 11 and of the packaging blank 10 come into contact with mutually facing, inner edge zones of the belts 20, 21. The web 11 and packaging blank 10 are here uninterruptedly, that is to say over the entire conveying path, fixed to the belts 20, 21 by adhesion. In the present illustrative embodiment, adhesion is effected by applying suction air. For this purpose, the belts 20, 21 are provided with a row of suction holes 24 in the zone of contact with the web 11 and packaging blank 10. Through these suction holes, suction air is conducted to the web 11 and packaging blank 10 for releasable fixing to the belts 20, 21.

To form the packaging blanks 10, a transversely directed severing cut 25, which extends over the full width of the web 11, is made in the web 11 in the zone of the conveying path, that is to say in the zone of the belts 20, 21. The severing cut 25 is made by a stationary blade device 26 which here consists of a revolving severing blade 27 and a fixed counterblade 28. The severing blade 27 is mounted on a blade roller 29 which is driven in rotation.

The belts 20, 21 are provided at intervals with recesses 30 and 31 of the type of elongate holes, which are formed in the zone of the mutually facing sides and have such a transverse dimension that the severing blade 27 and counterblade 28 can become effective with their full length, their end zones passing through the recesses 30 and 31. As can be seen in particular from FIGS. 2 and 3, the depth of the recesses 30, 31 is somewhat greater than the length of the severing blade 27 and counterblade 28. The latter are, in turn, somewhat longer than the width of the web 11.

Since the recesses 30 and 31 ensure that the blades 27, 28 pass through unhindered, the belts 20, 21 can be formed to any suitable width. Outside the zone of the recesses 30, 31, that is to say in the continuous path of the belts 20, 21, carrier holes 32 are provided, in which stud-like projections 33 of the driven guide roller 22, that is to say of the upper guide roller in the present case, positively engage in order to transmit the drive force to the belts 20, 21.

A device for transmitting the suction air to the belts 20, 21 is here formed, by way of example, in the same way as in German Pat. No. 2,530,992. The belts 20, 21, or their section facing the web 11 or the packaging blanks 10, run in the zone of an upright support plate 34. The latter extends laterally beyond the belts 20, 21. That surface of the support plate 34 which faces the web 11 or packaging blanks 10 is substantially flush with the outer upper side of the belts 20, 21. The latter are guided in correspondingly sized flat grooves 35, 36 of the support plate 34 (see in particular FIG. 6).

On that side of the belts 20, 21 which faces away from the web 11 or packaging blanks 10, narrow upright suction nozzles 37, 38 with suction lines 39, 40 adjoin the support plate 34. The suction nozzles 37, 38 extend over almost the entire height of the belts 20, 21. The suction lines 39, 40 are connected to a vacuum source.

In the present illustrative embodiments, a further blade arrangement 41 is located upstream of the conveying path 19. In conjunction with a severing device 42 which is located here upstream of the draw rollers 17 and 18 and which works in the longitudinal direction, this further blade arrangement serves to produce a gripping tab 43 for forming a tear-open strip on the packaging blank 10.

Different formats or lengths of blank can be processed by adjusting the speed of revolution of the draw rollers 17 and 18, whilst the conveying speed of the belts 20, 21 remains constant. The mutual spacing of the recesses 30 and 31 of a belt 20, 21 is designed for a defined maximum length of blank. This maximum length is reached when the web 11 is fed in at the same speed as a result of correspondingly driving the draw rollers 17, 18. A shorter length of blank can be obtained by a lower speed of revolution of the draw rollers 17, 18 and a corresponding reduction of the conveying speed of the web 11—the latter being taken along by the belts 20, 21 with slip.

Using the apparatus described, webs and blanks of "critical" material can be transported in a perfect manner over a relatively great length as a result of uninterrupted lateral holding and guiding. The belts here extend down to a point below the mouthpiece 14 of the packing line 45. In this way, the blank 10 is fixed above and below the mouthpiece 14. The mutual spacings of the belts 20, 21 are here selected such that the pack 13 can be moved through between these belts 20, 21, the blank 10 being drawn off with slip.

I claim:

1. An apparatus for severing packaging blanks from a continuous web of packaging material, and for delivering the severed blanks to a package wrapping station, comprising:

(a) a continuous, elongated web (11) of packaging material having a width W, (b) a pair of endless, parallel, continuously driven conveyor belts (20, 21) spaced apart at facing inner edges thereof by a distance of less than W but greater than the width of packages to be wrapped, whereby outer edges of the web overlap the inner edges of the belts, (c) a plurality of holes (24) proximate the inner edge of each belt for communicating a vacuum pressure to overlapped outer edges of the web to hold the web on the belts for conveyance, (d) a severing knife (27) having a width slightly greater than W disposed transversely to the belts for periodic application against the web to sever packaging blanks (10) therefrom, (e) a plurality of opposite pairs of transversely oriented, longitudinally spaced, oblong cutouts (30, 31) defined in the respective inner edges of the belts and having depths extending beyond the width of the severing knife to permit the free passage thereof, (f) a wrapping station (12) disposed proximate the belts beyond the severing knife in the direction of conveyance, and (g) means for pushing an individual package (13) between the belts, against a severed blank, and into the wrapping station during the continuous conveyance of the web and severed blank, each package removing a severed blank from the belts during its passage.

2. An apparatus as defined in claim 1, further comprising:

(a) a pair of guide rollers (22, 23) disposed at opposite ends of runs of the belts, (b) a plurality of projections (33) upstanding from opposite ends of each roller outside of the width of the web, and (c) a plurality of apertures (32) in each belt for engagement with the projections.

3. An apparatus as defined in claim 1, further comprising:

(a) draw roller means (17, 18) for feeding the web onto the conveyor belts, and (b) means for driving the conveyor belts at a higher speed than the draw roller means.

4. An apparatus as defined in claim 2, further comprising:

(a) draw roller means (17, 18) for feeding the web onto the conveyor belts, and (b) means for driving the conveyor belts at a higher speed than the draw roller means.

* * * * *